United States Patent [19]

Chabot

[11] 4,224,007

[45] Sep. 23, 1980

[54] TOY SHOVEL

[76] Inventor: Gérard Chabot, 7 - 2nd Ave., Cadillac, Canada, J0Y 1C0

[21] Appl. No.: 945,608

[22] Filed: Sep. 25, 1978

[51] Int. Cl.[3] ..... E02F 3/75; A63H 17/12

[52] U.S. Cl. ..... 414/694; 414/915; 46/40

[58] Field of Search ..... 414/915, 694, 695; 46/40; 280/1.1 R; 296/28 B

[56] References Cited

U.S. PATENT DOCUMENTS

| | | | |
|---|---|---|---|
| 1,302,857 | 5/1919 | Sabina | 414/915 X |
| 1,827,541 | 10/1931 | Opperman | 414/915 X |
| 1,939,442 | 12/1933 | Gaver | 414/915 X |
| 1,955,457 | 4/1934 | Gaver | 414/915 X |
| 2,247,619 | 7/1941 | Penica | 414/694 |
| 2,503,340 | 4/1950 | Kipper | 414/915 X |
| 2,896,802 | 7/1959 | Hope | 414/694 |
| 3,539,063 | 11/1970 | Masura | 414/694 |

FOREIGN PATENT DOCUMENTS

| | | | |
|---|---|---|---|
| 103061 | 2/1966 | Denmark | 46/40 |
| 2040056 | 2/1972 | Fed. Rep. of Germany | 46/40 |
| 2334391 | 7/1977 | France | 414/694 |

*Primary Examiner*—Stephen G. Kunin
*Assistant Examiner*—Terrance L. Siemens

[57] ABSTRACT

A toy shovel is provided. The shovel comprises a seat, a first arm pivotally mounted on the seat and extending forwardly therefrom, a second substantially vertical arm pivotally mounted at its upper end on the first arm, a shovel mounted for pivotal movement on the lower end of the second arm, a first handle pivotally mounted on the seat and secured to the first arm for controlling the depth of the cut made by the shovel, a second handle pivotally mounted on the seat, and linkages interconnecting the second handle and the shovel for controlling the pivotal movement of the shovel.

3 Claims, 4 Drawing Figures

TOY SHOVEL

This invention relates to a toy and, more particularly, to a toy shovel.

BACKGROUND OF THE INVENTION

Various types of toy shovels are known. However, they are generally made for young children and are not of much interest to children over a certain age, because their operation is not challenging enough.

SUMMARY OF THE INVENTION

It is therefore the object of the present invention to provide a toy which is of relatively large size and which can be of much more interest to children of, say, five years and older.

The toy shovel, in accordance with the invention, comprises a seat, a first arm pivotally mounted on the seat at one end and extending forwardly therefrom, a second substantially vertical arm pivotally mounted at its upper end on the first arm, a shovel mounted for pivotal movement on the lower end of the second arm, a first handle pivotally mounted on the seat and secured to the first arm to control the depth of the cut made by the shovel, a second handle pivotally mounted on the seat, and linkages interconnecting the second handle and the shovel for controlling the pivotal movement of the shovel.

The seat is preferably mounted on a swivel base for allowing for a full 360° rotation of the shovel.

BRIEF DESCRIPTION OF THE DRAWINGS

The invention will now be disclosed, by way of example, with reference to the accompanying drawings, in which:

Referring to FIGS. 1–3 of the drawings, there is shown a toy shovel comprising a seat 10, secured to a seat-supporting structure 12 which is provided with a vertical shaft 14 pivotally mounted on a swivel base structure permitting rotation of the shovel by an angle of 360°. The base structure comprises a cylinder member 16 for receiving shaft 14, four legs 18 welded, or otherwise secured, to the cylindrical member 16 at one end and at the other end to skates 20. A low profile back 22 is secured to the seat by wing nuts 24.

Figure 1:
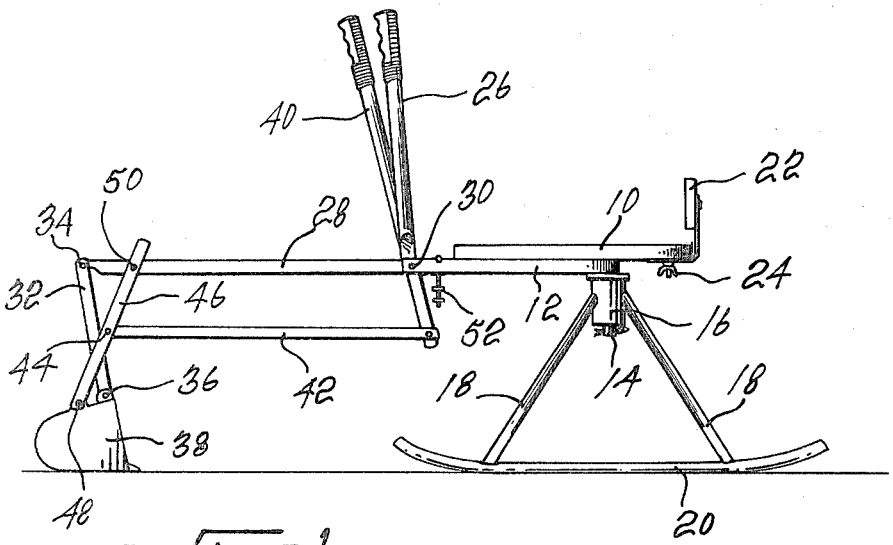
FIG. 1 is a side elevation view of a toy shovel in accordance with the invention.

A handle 26, which is integral with a forwardly extending arm 28, is pivotally mounted on seat-supporting structure 12 around axis 30. A vertical arm 32 is pivotally mounted at 34 to arm 28 and at 36 to a shovel 38. Operation of arm 26 in the forward direction from seat

10 permits control of the depth of the cut made by the shovel 38. A second handle 40 is pivotally mounted on the seat-supporting structure 12 around axis 30. Such second handle is pivotally connected to a link 42 which is itself connected to about the center point 44 of a second link 46. Link 46 is itself pivotally connected at 48 and 50 to shovel 38 and arm 28, respectively. Handle 48 permits control of the pivotal movement of the shovel about axis 36. It will be noted that the X-shaped arrangement of arm 32 and link 46 (as seen in side elevation) permits rotation of shovel 38 about axis 36 clockwise or anticlockwise during the corresponding clockwise or anticlockwise movement of arm 32 and link 46, so as to more easily scoop the earth in the same manner as the full size shovel. A stop 52 is mounted on support 12 for limiting the forward movement of handle 40.

Figure 2:
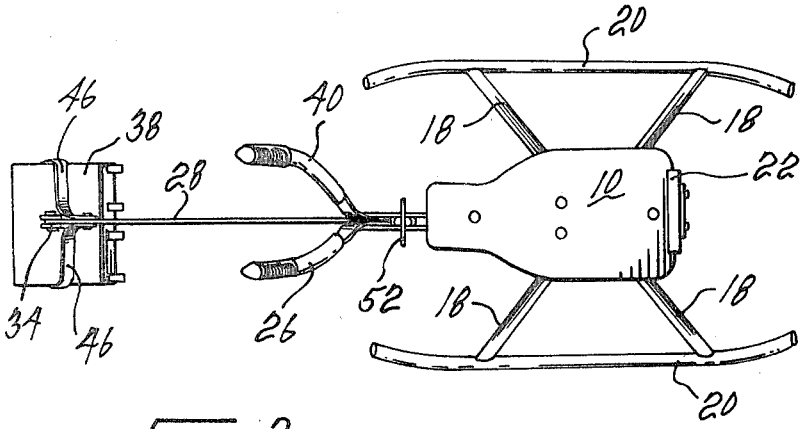
FIG. 2 is a plan view of the shovel shown in FIG. 1.
Figure 3:
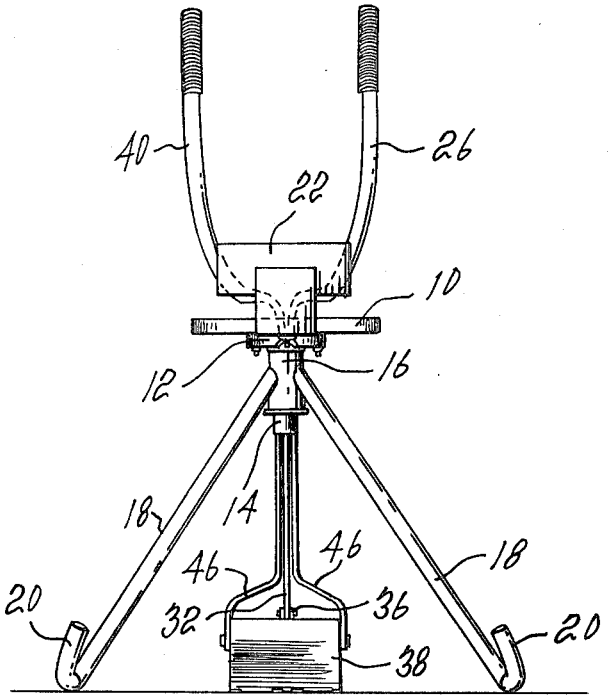
FIG. 3 is a view from the back of the shovel of FIG. 1.
Figure 4:
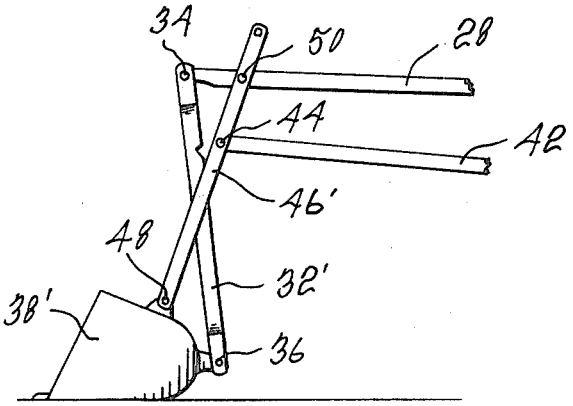
FIG. 4 is a partial view of a modified embodiment of the invention.

FIG. 4 of the drawings illustrates an embodiment which is similar to the one of FIGS. 1–3, except that arm 32', link 46' and shovel 38' are modified so that the shovel 38' is connected for working in the opposite direction. The operation is the same as the one of FIGS. 1–3.

Although the invention has been disclosed with reference to preferred embodiments, it is to be understood that it is not limited to such embodiments, but that various alternatives are also envisaged. For example, other linkage arrangements could be used to pivot the shovel. Furthermore, the seat does not necessarily have to be mounted for swivel movement around a vertical axis, although this feature is more desirable.

What I claim is:

1. A toy shovel comprising:

(a) a seat;

(b) a first arm pivotally mounted on said seat at one end and extending forwardly therefrom;

(c) a second substantially vertical arm pivotally mounted at its upper end to said first arm;

(d) a shovel mounted for pivotal movement at the lower end of said second arm;

(e) a first handle pivotally mounted on said seat and secured to said first arm for controlling the depth of the cut made by said shovel;

(f) a second handle pivotally mounted on said seat; and (g) linkages interconnecting said second handle and said shovel for controlling the pivotal movement of said shovel, said linkages including a first rigid link pivotally joining said shovel to said first arm, and a second rigid link pivotally joining said second handle to said first link.

2. A toy shovel as defined in claim 1, further comprising a swivel base for pivotally mounting said seat for full 360° rotation of the shovel.

3. A toy shovel as defined in claim 2, further comprising means located on said seat for limiting the swivel movement of said shovel.

* * * * *